US006148780A

United States Patent [19]

O'Neill et al.

[11] Patent Number: 6,148,780

[45] Date of Patent: Nov. 21, 2000

[54] HYDRAULIC ELEMENT ASSEMBLY

[75] Inventors: Daniel Patrick O'Neill, Fairport, N.Y.; Charles Michael Philo, Hudsonville, Mich.; Albert C. Stone, Grandville, Mich.; William Paul Vukovich, Wyoming, Mich.

[73] Assignee: Delphi Technologies, Inc., Troy, Mich.

[21] Appl. No.: 09/282,738

[22] Filed: Mar. 31, 1999

[51] Int. Cl.[7] ..... F01L 1/24; F01L 1/18

[52] U.S. Cl. ..... 123/90.46; 123/90.55

[58] Field of Search ..... 123/90.39, 90.45, 123/90.46, 90.49, 90.52, 90.55

[56] References Cited

U.S. PATENT DOCUMENTS

| | | | |
|---|---|---|---|
| 4,708,103 | 11/1987 | Speil | 123/90.46 |
| 4,856,468 | 8/1989 | Speil et al. | 123/90.47 |
| 5,632,237 | 5/1997 | Cornell et al. | 123/90.46 |
| 5,680,838 | 10/1997 | See et al. | 123/90.46 |
| 5,706,771 | 1/1998 | Van Heyningen et al. | 123/90.46 |
| 5,890,463 | 4/1999 | Speil | 123/90.46 |

FOREIGN PATENT DOCUMENTS

0758046A1 2/1997 European Pat. Off. .

*Primary Examiner*—Weilun Lo
*Attorney, Agent, or Firm*—John A. VanOphem

[57] ABSTRACT

A hydraulic lash adjuster for disposition between a rocker arm and a valve stem of an internal combustion engine comprises a body having an axially extending neck depending from a lower end thereof. An enlarged head portion extends from the terminal end of the neck and has a semispherical lower surface. A foot assembly includes a disk shaped foot with an upper surface, a lower surface and a cylindrical sidewall defining an outer perimeter. The upper surface has a socket configured to receive the enlarged head. The foot assembly further includes an inverted cup shaped retainer having a cylindrical wall and radial leaves extending inwardly from the upper end of the cylindrical wall, defining a central opening. The axially extending neck extends through the central opening and the opening has a diameter smaller than the enlarged head. The cylindrical wall of the retainer is parallel to the cylindrical sidewall of the foot and is sized to define a parallel frictional force therebetween sufficient to maintain engagement of the foot and retainer. The retainer operates to prevent disassembly of the body and the foot assembly.

6 Claims, 4 Drawing Sheets

HYDRAULIC ELEMENT ASSEMBLY

TECHNICAL FIELD

The invention relates to hydraulic lash adjusters for internal combustion engines.

BACKGROUND OF THE INVENTION

Hydraulic lash adjusters are known to be useful in reducing lash, or extra clearance, in a valve train during operation of an internal combustion engine. A cam rotates and actuates a rocker arm to translate an engine valve to an open or closed position. A lash adjuster is disposed within the rocker arm and interfaces with the valve stem. The lash adjuster includes a follower body with a depending neck portion and enlarged diameter head portion. The head has a semispherical lower surface that is in rolling contact with a complementary socket in a foot member, allowing the foot member to swivel. Typically a retainer maintains the rolling contact by joining the foot member to the follower body. The means of retention is important to effect a permanent attachment that allows for sufficient swivel movement of the foot, while not complicating the manufacture of the components.

In some prior designs, a retainer is not used. Instead the design relies on valve spring preload to retain the foot in position. See U.S. Pat. No. 4,708,103. The disadvantage comes in assembling the separate foot and body into the engine. Also, upon disassembling the rocker arms, the foot portion may fall into the engine block.

When a retainer is part of the design, the retainer typically engages either or both the foot and the body of the adjuster through radial flanges or protrusions engaging a groove or indent. See U.S. Pat. Nos. 5,632,237 and 4,708,103. This approach requires additional machining of the foot to provide a receiver such as a groove or indent. Further the retainer cannot simply be drawn but requires shape changes to produce radial protrusions. Assembly is also disadvantaged if the foot and retainer must be oriented such that the protrusion and groove are aligned prior to assembly.

SUMMARY OF THE INVENTION

The present invention relates to a hydraulic lash adjuster which may be mounted within a rocker arm to contact a valve stem. The body of the lash adjuster includes a semispherical head that is in substantial rolling contact within a socket provided in a disk shaped foot member where the foot member has an upper surface, a lower surface, and a cylindrical sidewall. The invention provides a simplified means for retaining the head of the body within the foot socket. A retainer shaped as an inverted cup includes a cylindrical wall with radial leaves extending inwardly from an upper end of the cylindrical wall to define a central opening, which allows insertion of the head, to assemble the body to the foot without permitting disassembly. The cylindrical wall of the retainer is parallel to the cylindrical sidewall of the foot member and securely fits over it. The diameters of the complementary cylindrical walls are sized to establish a parallel frictional force therebetween to prevent disassembly. This configuration provides for improved ease of manufacturing and assembly of the retainer and foot member as further operations are not needed to establish radial interference between the members, such as protrusions, flanges, grooves, or indentations.

The details, as well as other features and advantages of the invention, are set forth in the following detailed description and drawings.

DESCRIPTION OF THE PREFERRED EMBODIMENT

Figure 1:
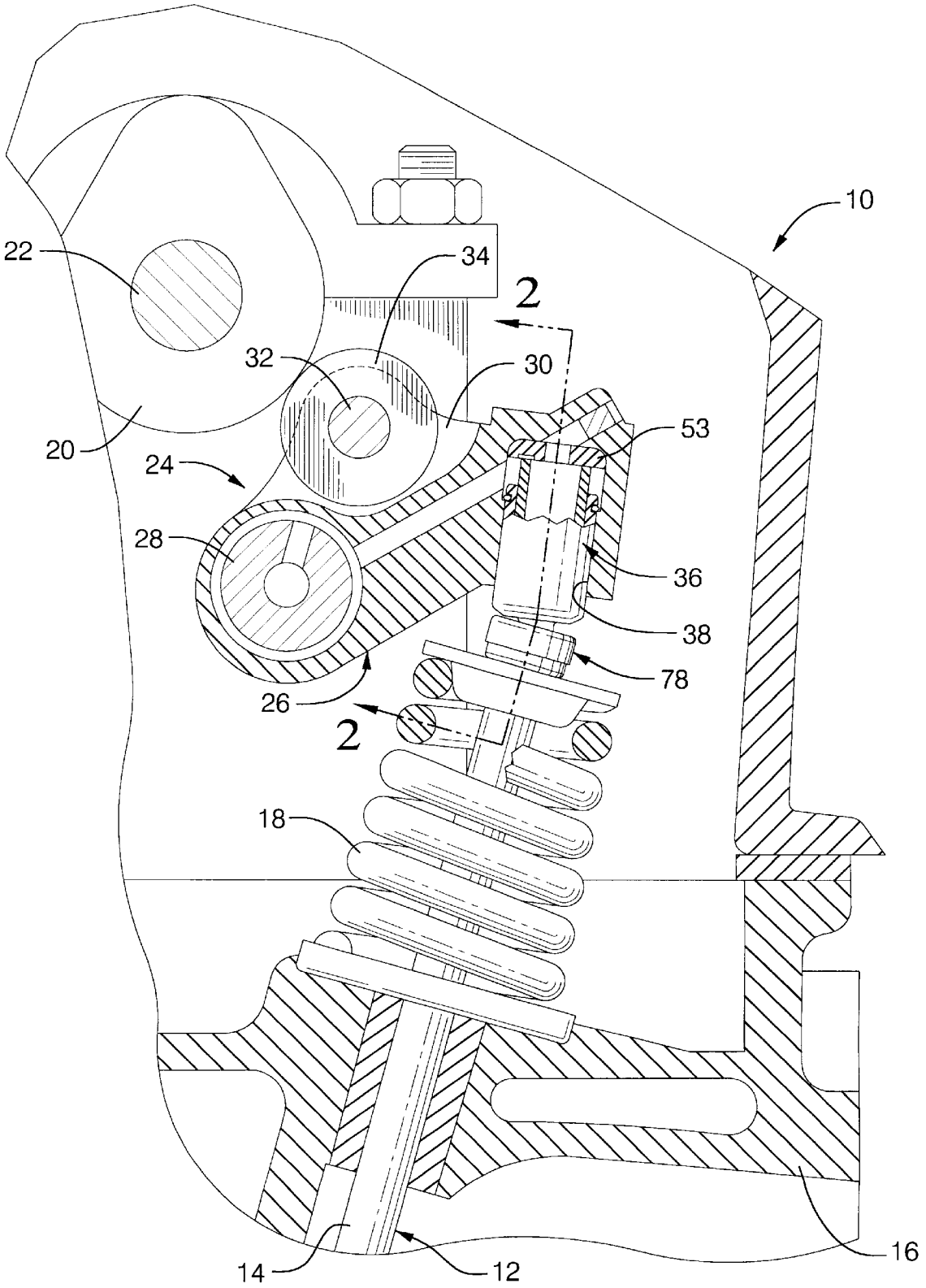
FIG. 1 is a partial, sectional view of an internal combustion engine which embodies features of the present invention.

FIG. 1 illustrates a portion of an internal combustion engine, designated generally as 10. The engine includes a poppet valve 12 having a valve stem 14, supported in a cylinder head 16. The valve 12 operates to open and close either an inlet or exhaust port to the combustion chamber, not shown. A valve spring 18, located coaxially about the valve stem 14, biases the valve 12 in the closed position.

The valve stem 14 is actuated by a cam 20 mounted on a camshaft 22 via a rocker arm assembly 24. The rocker arm assembly 24 includes a rocker arm 26 rotatably supported on a rocker shaft 28 and overlying the valve stem 14. The rocker arm 26 has two side walls 30 which fixedly support a shaft 32 for a roller cam follower 34. The roller cam follower 34 rotates on the shaft 32 and directly interfaces with the cam 20. A hydraulic lash adjuster 36 is received within a stepped bore 38 in the rocker arm 26 and provides the interface between the rocker arm and the valve stem 14. The hydraulic lash adjuster 36 operates to minimize lash therebetween.

Figure 2:
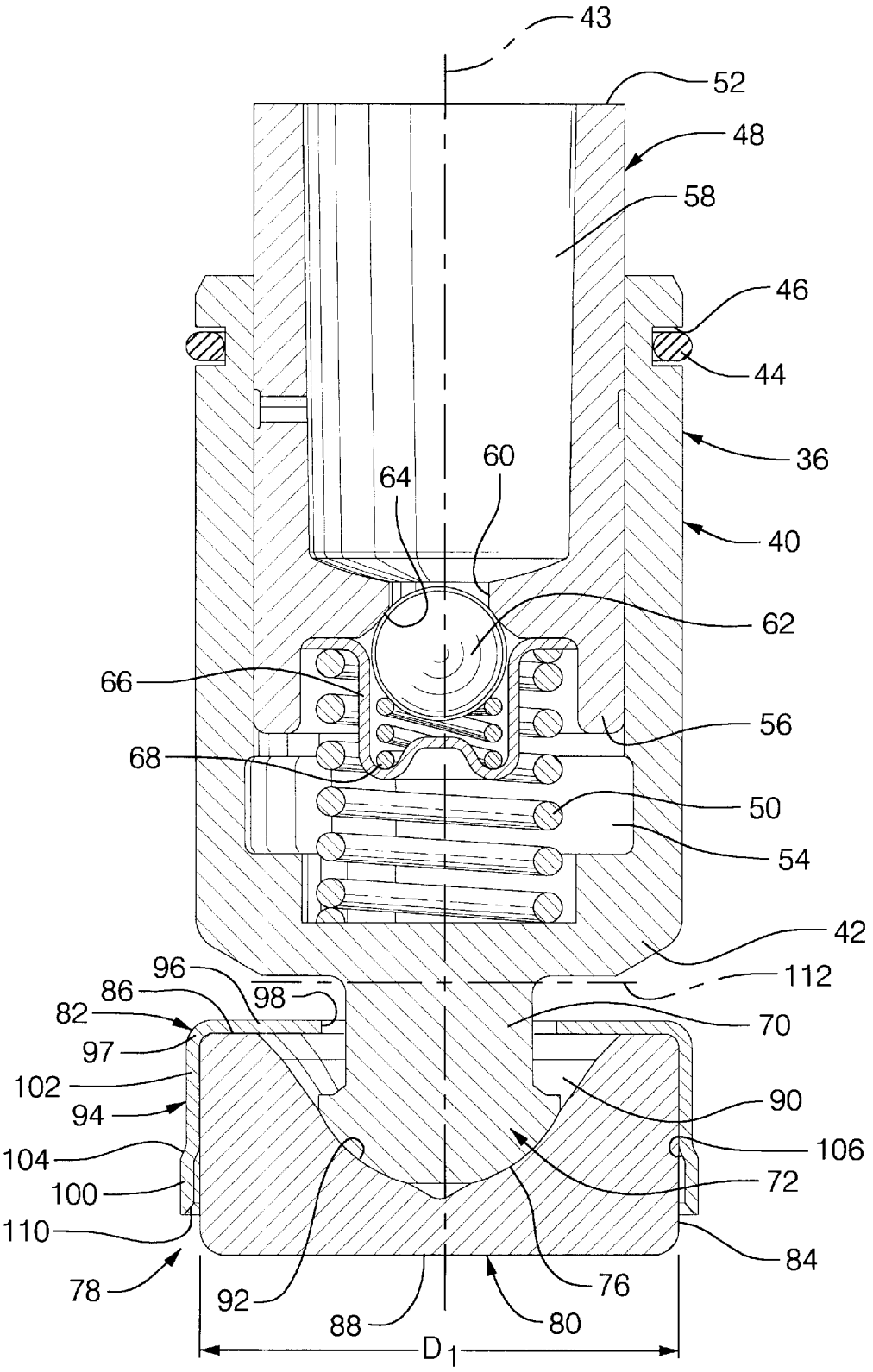
FIG. 2 is a sectional view of the hydraulic lash adjuster illustrated in the engine of FIG. 1 taken along line 2—2.

FIG. 2 provides greater detail of the hydraulic lash adjuster 36. A follower body 40 is of substantially conventional construction and is of a cylindrical cup shape, having a closed lower end 42 and defining a central axis 43. The body is slidably received in the stepped bore 38 of the rocker arm 26. The adjuster 36 is axially retained for limited movement within the stepped bore 38 by a retainer ring 44, located in an annular groove 46 about the outer periphery of the follower body 40, which registers with the shoulder to limit downward travel of the follower body.

A plunger 48 is disposed within the cylindrical follower body 40 for reciprocation therein. The plunger 48 is normally biased upwardly by a plunger spring 50 so that its upper end 52 abuts disc 53, shown in FIG. 1, to operatively engage the rocker arm 26. The plunger spring 50 also acts against the closed lower end 42 of the follower body 40 to maintain operative engagement with the upper end of the poppet valve stem 14.

A pressure chamber 54 is formed between the lower end 56 of the plunger 48 and the closed lower end 42 of the follower body 40. A supply reservoir 58 is defined by the open upper end 52 of the plunger and is in flow communication with the pressure chamber 54 via a port 60. Flow through the port 60 is controlled by a one-way valve in the form of a ball 62 which closes against a seat 64 disposed about the port.

A suitable valve cage 66 and valve return spring 68 limit open travel of the valve ball 62 to that necessary to replenish the pressure chamber 54 with oil which normally escapes between the sliding surfaces of the plunger 48 and the follower body 40 as "leakdown" during cam-induced opening of the poppet valve 12. The valve cage 66 may be held in position against the plunger 48 by the plunger spring 50 or by an interference fit to the plunger.

The closed lower end 42 of the follower body 40 includes a depending axially extending neck portion 70 with an enlarged diameter head portion 72. The head 72 includes a semispherical surface 76.

A foot assembly 78 includes a swivel foot 80 and a retainer 82, operable to retain the foot to the follower body 40. The foot 80 is a disk-like member having an upper surface 86, a lower surface 88, and a cylindrical sidewall 84 defining an outer diameter $D_1$. The lower surface 88 is configured for contact with the terminal end of the poppet valve stem 14. The upper surface 86 opens into a socket 90, having a semispherical lower surface 92 with radii which are complementary to the radii of the semispherical surface 76 of head portion 72.

Figure 4:
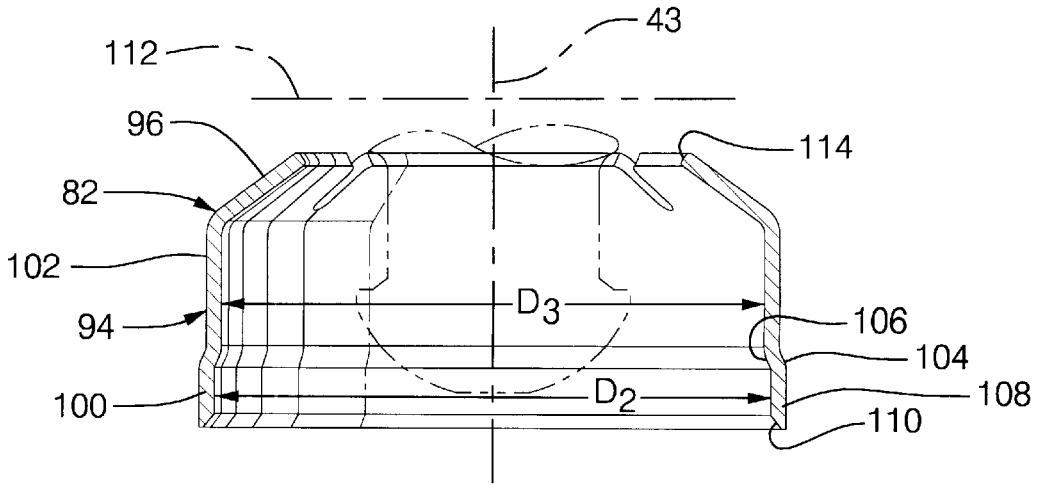
FIG. 4 is a sectional side view of the retainer of FIG. 3 taken along line 4—4.

The retainer 82 is shaped as an inverted cup with an outer generally cylindrical wall 94 and depending radial leaves 96 extending inwardly from the upper end 97 of the cylindrical wall. The radial leaves 96 extend inwardly to define a central opening 98. As shown in FIG. 4, the generally cylindrical wall 94 is comprised of a lower pilot cylinder 100 having an inside diameter $D_2$ and an upper retaining cylinder 102 having an inside diameter $D_3$. The pilot cylinder inside diameter $D_2$ is larger than the retainer cylinder inside diameter $D_3$. Further the outer diameter $D_1$ of the cylindrical sidewall 84 of the foot 80 is larger than the retaining cylinder inside diameter $D_3$ but equal to or smaller than the pilot cylinder inside diameter $D_2$. A shoulder 104 extends between the lower pilot cylinder 100 and the upper retaining cylinder 102 and defines a ramp 106 on the inside of the cup-shaped retainer 82 as a transition between the pilot cylinder and the retaining cylinder. The lower end 108 of the pilot cylinder 100 includes an interior radiused edge 110 to assist inserting the foot 80 into the retainer 82. The retainer 82 is preferably constructed of a material having a high modulus of elasticity, such as spring steel.

Figure 3:
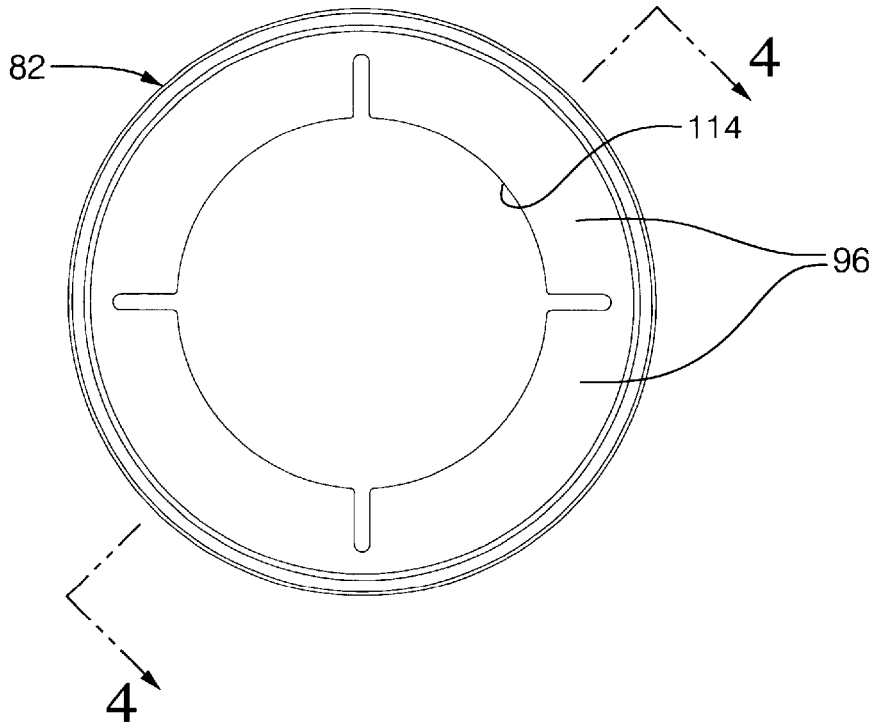
FIG. 3 is a plan view of the retainer for the hydraulic lash adjuster in pre-assembly state.

Prior to assembly, the radial leaves 96 of the retainer 82 are initially formed at an upwardly extending angle from a horizontal axis 112, as shown in FIG. 4. In this configuration, the radial leaves 96 define an insertion passage 114, also shown in FIG. 3.

Figures 5A, 5B, 5C, 5D:
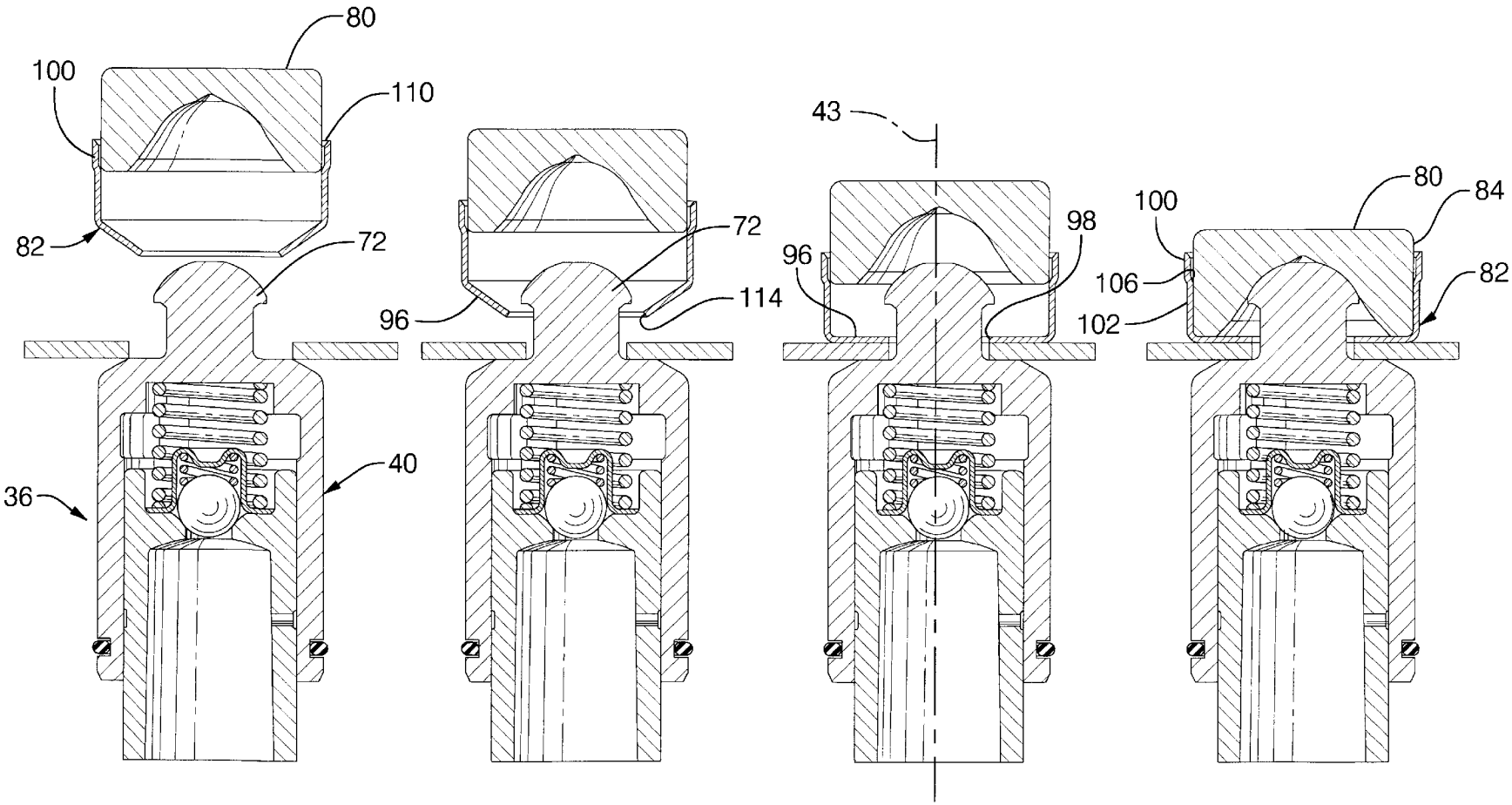
FIGS. 5A–D illustrate the method steps of assembling the foot assembly to the follower body of the hydraulic lash adjuster.

FIGS. 5A–D illustrate the steps for assembling the foot assembly 78 to the follower body 40 of the hydraulic lash adjuster 36. FIG. 5A illustrates the foot 80 inserted in the pilot cylinder 100 of the retainer 82, eased by the interior radiused edge 110. The head 72 of the follower body 40 is inserted through the insertion passage 114 in the retainer 82 as shown in FIG. 5B. To secure the assembly, the radial leaves 96 of the retainer 82 are bent inwardly as referenced in FIG. 5C, such that the leaves are approximately normal to the central axis 43, to define the central opening 98. As illustrated in FIG. 2, the central opening 98 is sized with a smaller diameter than the head 72 to prevent disassembly of the retainer 82 from the follower body 40, but with a larger diameter than the neck portion 70 such that the retainer loosely encircles the neck portion 70.

To complete the assembly, FIG. 5D, the foot 80 is pressed in the retaining cylinder 102 with the assistance of the ramp 106 which eases the transition between the pilot cylinder 100 and the retaining cylinder. The retaining cylinder 102 is parallel to the foot cylindrical sidewall 84 and together they define a parallel frictional force between the retainer 82 and the foot 80, sufficient to prevent disassembly. The parallel cylindrical sidewall 84 of the foot 80 and the retaining cylinder 102 of the retainer 82 provide simple designs to manufacture.

During operation of the engine 10, the rocker arm 26 pivots to open and close the poppet valve 12. The effective operative contact point between the rocker arm 26 and the terminal end of the valve stem 14 moves laterally across the stem terminal surface. The foot assembly 78 being loosely disposed about the neck 70 of the follower body 40, allows for pivotal movement between the complementary semispherical surfaces 76,92 of the foot socket 90 and the head 72 allowing for relative angular movement between the lash adjuster body 40 and the foot assembly 78 to thereby reduce scrubbing engagement between the lash adjuster 36 and the valve stem 14.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A hydraulic lash adjuster for disposition between a rocker arm and a valve stem of an internal combustion engine comprising a body having an axially extending neck depending from a lower end thereof, an enlarged head portion extending from the terminal end of said neck and having a semispherical lower surface, said lash adjuster further comprising a foot assembly including a disk shaped foot having an upper surface, a lower surface and a cylindrical sidewall defining an outer diameter, said upper surface having a socket configured to receive said enlarged head therein, said lower surface configured to contact said valve stem, said foot assembly further comprising an inverted cup shaped retainer having a generally cylindrical wall comprising a lower pilot cylinder and an upper retaining cylinder having an inside diameter smaller than said pilot cylinder and a shoulder extending therebetween, and depending radial leaves extending inwardly from an upper end of said retaining cylinder to define a central opening through which said axially extending neck extends, and said central opening having a diameter smaller than said enlarged head, said retaining cylinder of said retainer extending parallel to said cylindrical sidewall of said foot and wherein the inside diameter of said retaining cylinder is smaller than the outer diameter of said sidewall of said foot to provide a parallel frictional force therebetween to maintain said foot and said retainer in engagement, and wherein said retainer is operable to prevent disassembly of said body and said foot assembly.

2. A hydraulic lash adjuster, as defined in claim 1, wherein a lower end of said pilot cylinder of said retainer has an interior radiused edge to facilitate insertion of said foot into said pilot cylinder of said retainer.

3. A hydraulic lash adjuster, as defined in claim 1, wherein said shoulder of said cylindrical wall of said retainer defines a ramp on the inside thereof to facilitate insertion of said foot from said pilot cylinder to said retaining cylinder of said retainer.

4. A hydraulic lash adjuster, as defined in claim 1, wherein said central opening of said retainer having a diameter larger than the diameter of said neck of said body and operable to allow angular movement of said foot relative to said enlarged head of said body.

5. A method of assembling a hydraulic lash adjuster as set forth in claim 2, wherein said depending radial leaves extending inwardly and upwardly in an unassembled state to define an insertion passage and the radial leaves extending inwardly in an assembled state, said method comprising the steps of:

inserting the foot into the retaining cylinder of the retainer thereby securing the foot assembly due to the frictional force between the retaining cylinder of the retainer and the cylindrical sidewall of the foot;

inserting the head of the body into the insertion passage of the retainer; and after inserting the head, bending the radial leaves of the retainer inwardly to securely retain the head in the retainer to prevent disassembly of the foot assembly and the follower body while permitting pivotal movement between the socket of the foot assembly and the follower body.

6. A method of assembling a hydraulic lash adjuster as set forth in claim 2, wherein said depending radial leaves extending inwardly and upwardly in an unassembled state form the upper end of the retaining cylinder to define an insertion passage and the radial leaves extending inwardly in an assembled state, said method comprising the steps of:

inserting the foot into the pilot cylinder of the retainer;

inserting the head of the body into the insertion passage of the retainer;

after inserting the head, bending the radial leaves of the retainer inwardly to securely retain the head in the retainer; and pressing the foot into the retaining cylinder of the retainer eased by the shoulder, to thereby secure the foot in the retainer due to the frictional force between the retaining cylinder of the retainer and the cylindrical sidewall of the foot to prevent disassembly of the foot assembly and the follower body while permitting pivotal movement between the socket of the foot assembly and the follower body.

* * * * *